United States Patent [19]

Wolfthal

[11] 3,991,774

[45] Nov. 16, 1976

[54] HAIR CLIP WITH LEAF SPRING HINGE

[75] Inventor: Maurice Wolfthal, Ossining, N.Y.

[73] Assignee: Stewart Stamping Corporation, Yonkers, N.Y.

[22] Filed: Aug. 29, 1975

[21] Appl. No.: 609,000

[52] U.S. Cl. ..... 132/48 R

[51] Int. Cl.[2] ..... A45D 8/24

[58] Field of Search ..... 132/48 R, 46 A, 137; 24/248 HC, 252 HC; 128/354

[56] References Cited

UNITED STATES PATENTS

| | | | |
|---|---|---|---|
| 2,577,452 | 12/1951 | Cochran | 132/46 A |
| 2,641,266 | 6/1953 | Thatcher | 132/46 A |
| 3,213,509 | 10/1965 | Reiner | 132/46 A |

*Primary Examiner*—G.E. McNeill

*Attorney, Agent, or Firm*—Darby & Darby

[57] ABSTRACT

A hair clip assembled from two pronged members with rearward out-turned handle portions, one member having struck from it along each of its two edges, front and rear arms converging upwardly toward one another and terminating in ends defining respective small gaps, the other member having struck from it respective ears captively disposed in the gaps. One of the members also has struck from it a leaf spring extending rearwardly along its longitudinal axis and engaging a torsion spring struck from the rearward center portion of the other member.

11 Claims, 6 Drawing Figures

HAIR CLIP WITH LEAF SPRING HINGE

BACKGROUND OF THE INVENTION

Hair clips formed from two members having dual prongs normally urged together by a spring mechanism, providing a moment about a pivot means, and separable by application of pressure to handles on the side of the pivot means opposite the prongs of the members are generally known to the art. It is also known to strike from these members both resilient portions to serve as spring means and interconnecting portions to provide for attachment of the two members comprising the clip and to give the clip structural rigidity. For some of the prior art devices, a single means serves both functions, that is as a spring means and a connecting means. However, the hair clips heretofore known to the art suffer from several disadvantages which detract from their ease of fabrication and functional operability.

In fabricating the clip members from rolled sheet metal, it is desirable to form the members so that the clip may also be automatically assembled from the two members as part of the fabrication process. To facilitate such assembly it is necessary that the grain structures of the metal (the grains being elongated due to prior rolling operations) from which the clip members are formed run in identical directions in the finished assembly. In prior art hair clips such as the type disclosed in U.S. Pat. No. 3,101,725, the configuration of the leaf spring and prongs which hold the members together (not to be confused with the forward hair-grasping prongs) is such that to avoid fracture along elongated grain boundaries during formation of the prongs and leaf spring and during continued operation of the clip, the grain structure of the two members comprising the clip must run in opposite directions. Thus, if the two members are to be stamped from a single piece of sheet metal, one of the members must be reversed in space before the two members can be assembled. This prevents the hair clips from being assembled in a single automatic process.

The connecting and spring members of prior art devices also protrude above the outer surfaces of the assembled clip and tend to snag on the hair of the user. The outer dimensions of prior art hair clips are also generally asymmetrical with the handle portion of one of the members comprising the clip being turned at a relatively large angle to compensate for the relative flatness of the other member's handle and the lack of distance between the clip portions of the two members at their pivot point in order to achieve sufficient arc movement of the handle to adequately open the clip. The sharply out-turned handle portions of such clips and the portions which project beyond the outer surfaces of the clips often tend to cause discomfort to the user as for example when sleeping with the clips in place in the user's hair.

Further, the opening and closing action of prior art clips has been found to be generally stiff and often rough and uneven. The lateral rigidity of prior art clips, i.e., when forces are applied tending to laterally or angularly displace the two members in a horizontal plane substantially parallel to the surfaces of the clip, is also less than desirable since the prongs holding such clips together are generally of limited dimension in a direction along the longitudinal axis of the clips and hence have little resistance to rotation of one member relative to the other in the horizontal plane.

SUMMARY OF THE INVENTION

It is therefore an object of the invention to provide a hair clip which may be assembled from only two members.

Another object of the invention is to provide a hair clip wherein the means for interconnecting and biasing the two members so as to normally close the clip are struck from the members.

Still another object of the invention is to provide a hair clip wherein the means struck from the members do not project sufficiently beyond the outer surfaces of the hair clip to snag in a user's hair.

A further object of the invention is to provide a hair clip wherein the combined outward slopes of the handles are substantially less than that required by the prior art.

Still a further object of the invention is to provide a hair clip permitting smooth rotation in a vertical plane for opening and closing while substantially preventing horizontal rotation between its members for improved stability.

In accordance with a preferred embodiment of the invention, these and other objects are attained by providing a hair clip suitable for automatic assembly during fabrication of its two members and which includes means struck from the hair clip members to provide a smooth acting and stable hinge substantially without portions projecting beyond the outer members'surfaces and hence substantially eliminating the possibility of inadvertent snagging in the user's hair. More specifically, the invention contemplates an assembly comprising upper and lower pronged members having rearward out-turned handle portions. In between the front pronged ends and rear handle portions of each of the members, and closer to the handle portions, spring and pivot projections are struck from the members. In the preferred embodiment of the invention, the lower member has struck from it, adjacent each of its sides, front and rear arms converging upwardly toward one another and terminating in spaced ends defining respective small gaps. Along the longitudinal axis of the lower member, in between the pairs of arms formed on the member's sides, an upward sloping leaf spring is struck extending in a direction generally upward and to the rear and terminating at a point between the members rearward of the rear arms.

Struck and distending from the upper member at each of its sides are a pair of ears, preferably formed in parallel planes, having widened cam-shaped bottoms and narrowed portions captively disposed in the gaps formed between the ends of the respective front and rear arms struck from the bottom member. The structure of the ears creates a standoff or space between the clip portions of the members at this point, the significance of which will become clearer hereinbelow. Partially defined by the handle portion of the top member is a substantially E-shaped torsion spring having a portion which extends forward and downward into urging engagement with the upper surface of the leaf spring. The leaf and torsional springs are urged against each other resulting in a moment about the pivot point of the clip defined by the point of contact of the rear arms with the respective ears thereby urging the pronged forward ends of the members together.

When the handles of the closed clip are squeezed, the leaf spring is pushed downwardly by the torsion spring a portion of which slides along the upper surface of the leaf spring in a forward direction while the torsion spring is urged upwardly. At this time, the spring force urging the clip toward a closed position is provided solely by the leaf and torsion springs. In one preferred embodiment, as the clamp is nearly completely opened, the forward cam-like edges of the ears engage the resilient front arms and lift them creating an additional closing force. The rear arms serve to longitudinally stabilize the upper and lower members with respect to one another and to provide a pivot point about which the upper member may be turned. The front arms also provide longitudinal stabilization and, in addition, may exert secondary spring tension on the ears of the upper member when the clip is opened.

By virtue of the structure described hereinabove, both clip members may be formed having their grain structures running in the same direction. More specifically, whereas the long dimensions of the grains in the upper member are constrained to run in a direction transverse to the longitudinal dimension of the upper clip member due to the severe right angle bend of the ears, the grains in the lower clip member may also run in the same direction since even though bends are made in the transverse direction, none form sharp corners as is generally the case in the prior art. Rather, all bends have relatively large radii of curvature. Therefore, the clip members may be stamped simultaneously from the same sheet with the grains running in the same direction with the clip being automatically assemblable.

The above described structure also results in a clip wherein there are no substantial projections beyond the outer surfaces of the clip members, which is relatively laterally rigid, and which has a smooth opening action. Further, the clip opens wider than prior art clips with less arc movement of the handles.

Other and further objects of the invention will be apparent from the following drawings and description of a preferred embodiment in which like reference numerals are used to indicate like parts in the various views.

DESCRIPTION OF THE PREFERRED EMBODIMENT

Figure 1:
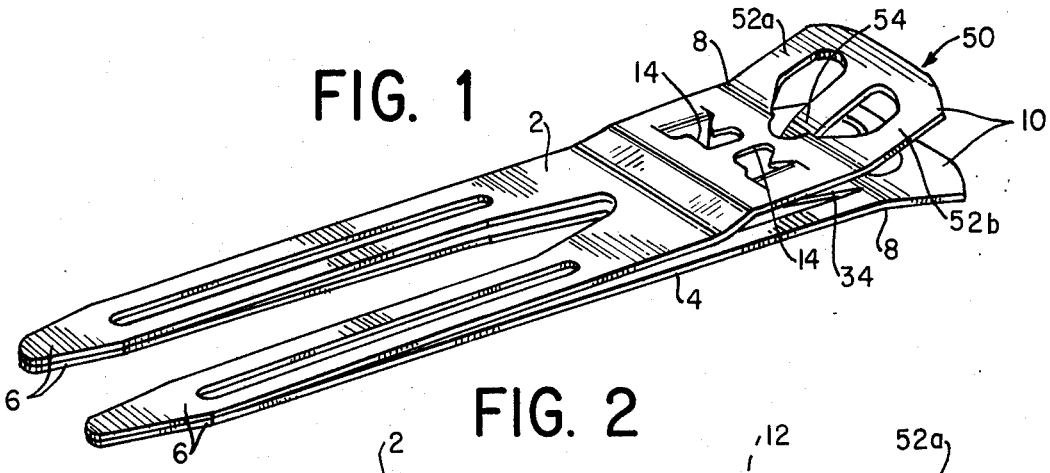
FIG. 1 is a perspective view of the preferred embodiment of the invention.

Referring now to the drawings, specifically FIG. 1, a hair clip comprises an upper member 2 and a lower member 4. The front portions of the respective upper and lower members are in the form of prongs 6 and the rearward portions are outwardly bent along transverse fold lines at 8 to form respective handles 10. A bridging member (not shown) may be provided to interconnect the prongs as is well known in the art. The clip members may be formed from any resilient material having an elastic limit such as to permit the handle portions 10 and other portions struck from the members 2 and 4, later described, to be permanently bent into a desired shape when the elastic limit is exceeded by an applied force, while the material remains resilient upon application of forces which do not cause the elastic limit to be exceeded. Various steels and other metals are commonly known which satisfy these requirements.

Figure 2:
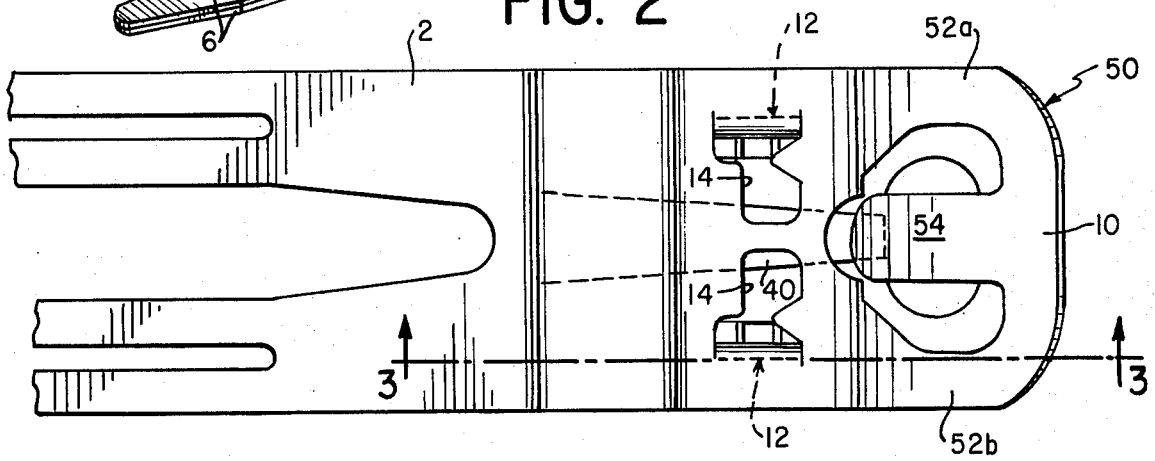
FIG. 2 is a fragmented plan view of the preferred embodiment of the invention showing its rearward portion.

Struck from the upper member 2 are two ears 12 which are bent downward into positions preferably substantially transverse to the plane of the upper member 2. The areas 14 in the upper member 2 from which the ears 12 are struck are best shown in FIG. 2.

Figure 6:
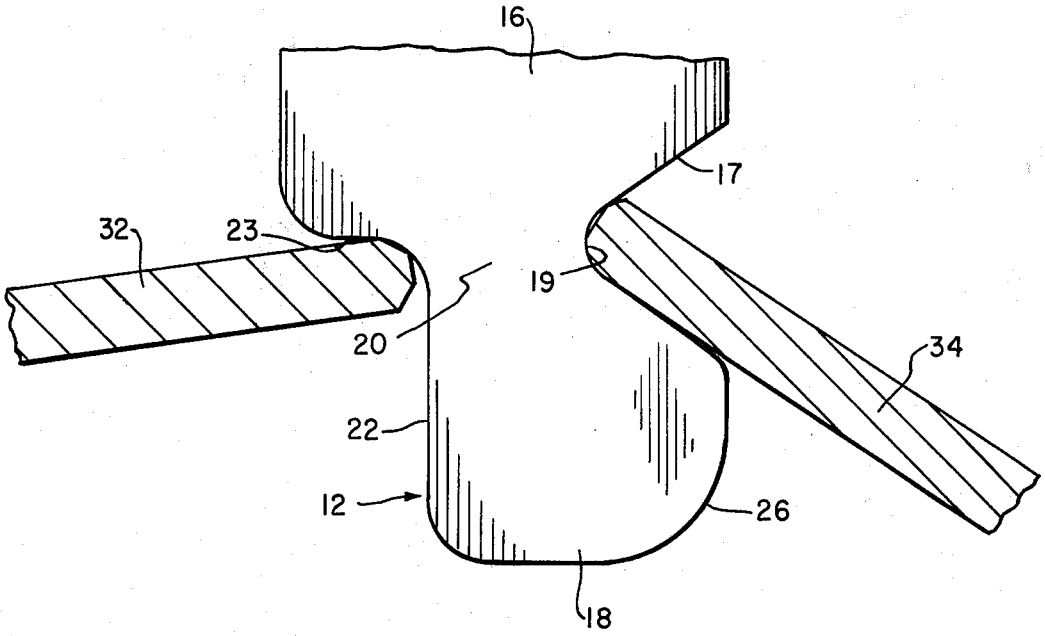
FIG. 6 is an enlarged partial sectional side elevation of the connection between an ear of the upper member and corresponding front and rear arms of the lower member.

Referring to FIG. 6, each ear 12 comprises an upper widened portion 16, the upper end of which is integrally connected to upper clip member 12. The central rear edges 17 of ear 12 is substantially notch-shaped, the notch edge having an apex 19, which defines a central narrowed portion 20. A widened, cam-like, lobe portion 18 forms the lower end portion of ear 12.

The ears 12 are flat and are preferably disposed in substantially parallel planes and, in the preferred embodiment of the invention, their lower lobes 18 have forward edges 22 substantially transverse to the surface of the upper member 2 with the notch-shape rear edge 17 terminating in a rounded edge 26. The slopes of the forward and rearward edges 22 and 17 of the lobes 18 may be altered to vary the equilibrium position of the upper member 2 relative to the lower member 4 or to affect spring tension as will later be described.

The lower member 4 has a front pronged portion substantially symmetrical to the front portion of the upper member 2 and a rearward portion complimentary to that of the upper member 2. Specifically, there are struck from the lower member 4 adjacent each of its rearward edges 30, front arms 32 and rear arms 34. The front arms 32 and rear arms 34 adjacent each respective edge 30 of the lower member 4 slope upward toward each other with each pair of front and rear arms defining a gap 21 (Fig. 5) corresponding in position to a respective ear 12 and in which the tapered portions 20 of the ears 12 are respectively received.

Figure 5:
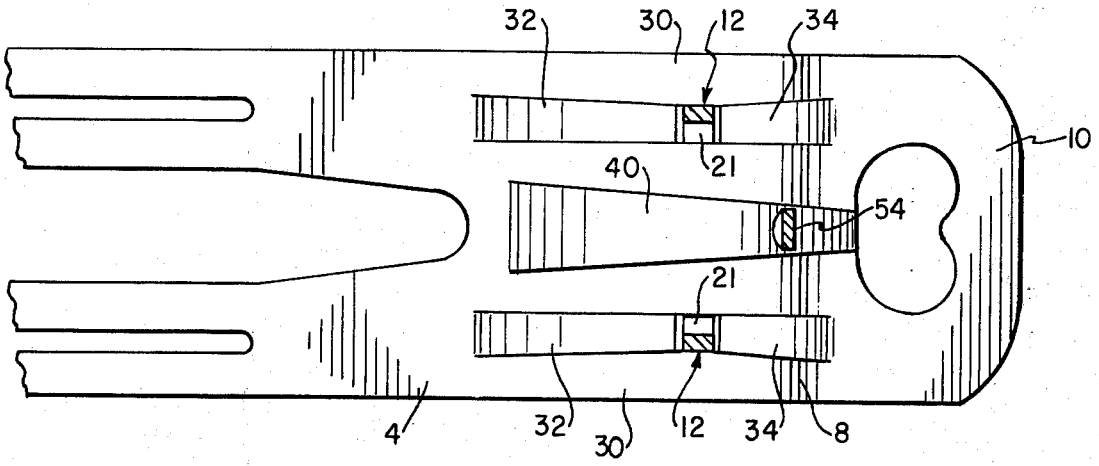
FIG. 5 is a fragmented plan view of a preferred embodiment of the invention taken along line 5—5 of FIG. 3.

Referring to FIG. 5, the arms 32, 34 preferably have a tapered configuration, becoming wider in a direction away from the arm ends so as to give greater strength to the area in which the arms are bent upwardly from the bottom member. Further, it is seen that the ears 12 are thinner than the width of the gap defined by the respective pairs of arms to facilitate assembly. Additionally, added strength and flexibility for the assembly is provided by virtue of the arms 34 being wider than the ears 12. Further, the outwardly facing surfaces of the ears 12 are adapted to substantially bear against the outer edges of the respective gaps. This provides the individual clip members with a lateral rigidity with respect to each other heretofore unattainable.

When the ears 12 are received in respective gaps 21, the end of each rear arm 34 rests in the apex 19 and due to the resiliency of the material from which it is constructed exerts a small downward or restraining force on the ear. This force urges the front, lower surface 23 (FIG. 6) of upper, widened ear portion 16 against the end of front arm 32. The coaction of front and rear arms 32, 34 captures ears 12 within gaps 21.

The points at which the ends of rear arms 34 rest in apices 19 of ears 12 define the axis of rotation of the clip and during opening and closing of the clip, these points remain substantially fixed in space (although a slight movement may be inherent due to the flexure of the material).

Struck from the lower member 4 of the hair clip is a leaf spring 40 sloping upward and rearwardly in a longitudinal direction from the lower member 4 forward of the front arm 32 and terminating at a point intermediate the upper member 2 and lower member 4 rearward of apices 19 of ears 12.

Figure 3:
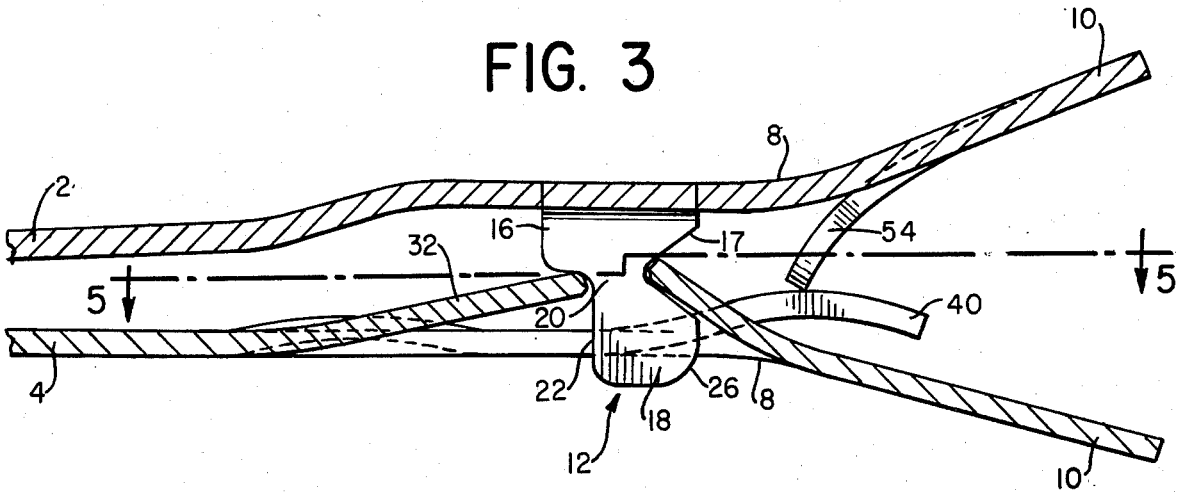
FIG. 3 is a fragmented side view in partial section taken along the line 3—3 of FIG. 2.

A portion of the handle 10 of upper member 2 of the hair clip defines a substantially E-shaped torsion spring, generally denoted as 50 (FIGS. 1 and 2). Torsion spring 50 comprises a pair of longitudinally extending end members 52*a* and 52*b* integral with the main portion of member 2 and terminating at the transverse fold line 8 and a central member 54 which extends forwardly in a longitudinal direction in a generally downward direction. In the closed configuration of the hair clip, the end of the central member 54 of torsion spring 50 is engaged with and biased against the upper surface of leaf spring 40 resulting in opposed forces being present between handle portions 10. This results in a constant counterclockwise moment (as seen in FIG. 3) on upper clip member 2 (and, similarly, an equal constant clockwise moment on lower clip member 4) with respect to the axis of rotation of the clip defined by the apices 19 of ears 12 tending to maintain the clip in its closed configuration.

In operation of the hair clip, when the handle portions 10 are urged toward each other, the end of central member 54 of torsion spring 50, which is in sliding engagement with the upper surface of leaf spring 40, moves the leaf spring 40 downward and, conversely, the force of leaf spring 40 urges the central member 54 of torsion spring 50 upwardly (FIG. 4), the torsion spring 50 flexing about the transverse fold line 8. Although the opposing forces on the leaf and torsion spring 40, 50 increases due to the flexure of the same, the moment about the axis of rotation of the clip does not materially increase since the distance of the forces from the axis of rotation diminishes as the end of the torsion spring central member 54 slides over leaf spring 40 toward the apices of ears 12. This results in an unexpectedly smooth opening action for the clip.

Further, an additional advantage of this structure is that due to the flexing of torsion spring 50 about transverse fold line 8 in combination with the flexing of the leaf spring 40, the spring action is equivalent to a much longer spring which in the prior art devices, always either protruded well beyond the outer surfaces of the clip or took the form of a coil spring which prevented automatic assembly of the clip. Additionally, the combination of the torsion and leaf springs permits the clip to be operated well below the flexural limits of the material from which the clip is constructed. Also, the construction of torsion spring 50 inherently provides an opening in handle 10 of upper member 2 which facilitates securely grasping the clip.

The particular pivot structure of the present invention wherein the ears 12 are captured in gaps 21 further provide the advantage that a larger opening at the mouth or ends of the prongs 6 is possible with a shorter stroke or arc of movement of the handle. This is due to the standoff or separation of the upper and lower clip members in the vicinity of the axis of rotation of the clip.

In the preferred embodiment of the invention, the rear arms 34 are shorter in length than the front arms 32 so that they remain relatively rigid when the force necessary to open the clip is applied to the handle 10. The longer front arms 32 are less resistant to bending when contacted by the forward edges 22 of the ears 12 under opening pressure applied to handles 10. The front arms 32 are resilient and may, if so desired, be designed so that when the clip is opened far enough, the front edges 22 push against the undersides of the front arms 32 resiliently urging the arms 32 upwardly as leaf springs so that they thereby exert a downward directed force on the front edges 22 of ears 12 tending to close the clip.

As explained above, the lobes 18 of the ears 12 of the upper member 2 are received in the slots 21. The slots 21 confine the flat lobes 18 so as to prevent rotation and lateral shifting of the upper member 2 with respect to the lower member 4 in the horizontal plane for improved stability while permitting rotation of the upper and lower members with respect to one another in a vertical plane for opening and closing of the clip. Thus as the clip is opened and closed, the lobes 18 rotate forward and backward, respectively, in the slots. The front arms 32 and rear arms 34 prevent shifting of the upper member 2 with respect to the lower member 4 in a longitudinal direction further enhancing stability of the clip.

Figure 4:
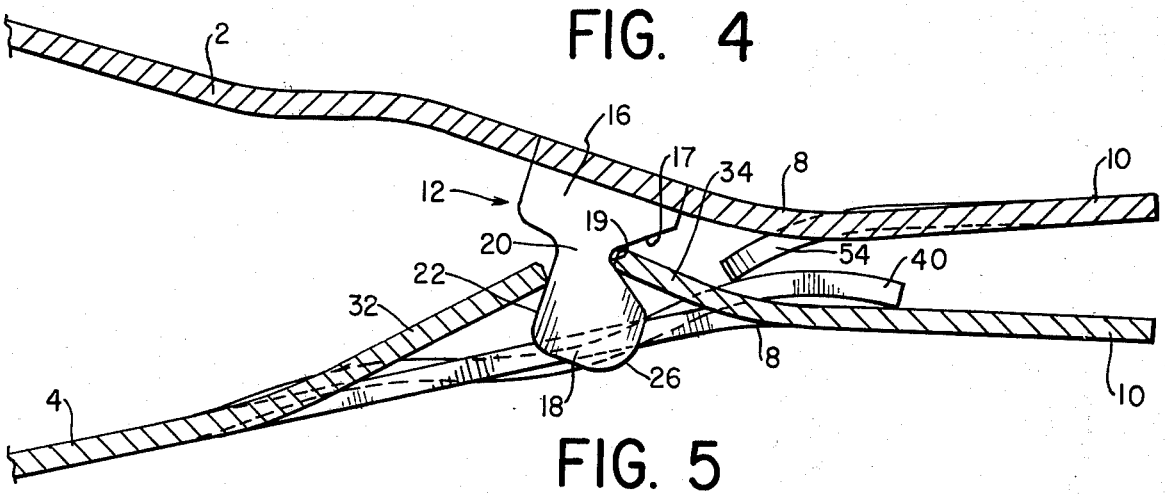
FIG. 4 is a fragmented side elevation of the preferred embodiment of the invention, with the hair clip open, in partial section.

Referring now to FIG. 4, summarizing the operation of the clip, as the clip is opened by squeezing the handles 10, the leaf spring 40 exerts a counterforce against the torsion spring 50, the mutually opposed forces of the leaf spring 40 and torsion spring 50 resulting in a moment tending to urge the clip closed. As opening of the clip continues with the lobes 18 of the ears 12 rotating in the slots 21, the front edges 22 may, if desired, be designed to engage respective front arms 32 pushing them upward. The front arms 32 in turn exert a counterforce against the front edges 22 of the ears 12 thus applying a force additional to that of the leaf spring 40 tending to urge the clip closed. It should be noted that the front edges 22 of ears 18 and/or the front arms 32 may be so designed, within the scope of the present invention, so that no closing forces are exerted on the ears during operation of the clip with the leaf and torsional springs 40, 28 respectively, applying the sole force tending to close the clip.

Obviously, numerous modifications and variations of the present invention are possible in the light of the above teachings. For example, the angle of the handles relative to the respective clip members need not be symmetrical to each other but may be different. Further, although it is preferred to have the grain boundaries of the upper and lower members running in the same direction to facilitate fabrication (which the design of the instant invention makes possible), the invention should not be construed to be limited to such structure, except as defined in the appended claims.

It is therefore to be understood that within the scope of the appended claims the invention may be practiced otherwise than as specifically described herein.

What is claimed is:

1. A hair clip comprising:

a first elongated member having a clip portion and a handle portion;

a second elongated member having clip and handle portions corresponding to said upper member's clip and handle portions;

means for pivotally securing said first member to said second member comprising a pair of ears extending from said first member in the vicinity of said handle portion, each ear being captured in a slot defined in one of a pair of corresponding gaps formed in said second member; and spring means operatively associated with said members for exerting a continual moment about said pivot means whereby said clip portions are normally urged to a closed position.

2. A hair clip as recited in claim 1 wherein each of said gaps is defined by at least one arm integrally formed from said second member.

3. A hair clip as defined in claim 1 wherein each of said ears has a notch formed in one of the edges thereof, said notch having an apex, said apices defining points substantially on the axis of rotation of said hair clip.

4. A hair clip as defined in claim 3 wherein each of said gaps is defined by at least one arm integrally formed from said second member, each arm having a terminal end located in said apex of a corresponding ear.

5. A hair clip as defined in claim 1 wherein each of said gaps is defined by a front arm and a rear arm integrally formed from said second member, said front arm adapted to engage said ear and urge the clip portions to a closed position upon opening said clip to a predetermined point.

6. A hair clip as defined in claim 1 wherein said first and second members are formed of a rolled metallic material having an elongated grain structure and wherein the longitudinal axes of said grain structures in said first and second members are oriented substantially transversely to the longitudinal axes of said first and second members.

7. A hair clip comprising:

a first elongated member having a clip portion and a handle portion;

a second elongated member having clip and handle portions corresponding to said upper member's clip and handle portions;

pivot means for rotatably connecting said first and second members to each other; and spring means located substantially entirely between said first and second members including a leaf spring formed on one of said members in the vicinity of said handle portion extending longitudinally between said members having a free end extending rearwardly of said pivot means and a torsion spring formed on the other of said members in the vicinity of said handle portion having a portion extending between said members and said torsion spring portion having a terminal end which engages said leaf spring in sliding and rotating contact rearwardly of said pivot means, said spring means exerting a continual moment about said pivot means whereby said clip portions are normally urged to a closed position.

8. A hair clip as defined in claim 7 wherein said torsion spring portion extends forwardly toward said pivot means so that upon moving said handle portions together to open said clip, said torsion spring portion terminal end moves toward said pivot means in sliding contact with said leaf spring.

9. A hair clip as defined in claim 7 wherein said torsion spring is formed in said handle portion of said other member and comprises a pair of longitudinally extending end members integral with said clip portion of said other member and a central member extending forwardly in a longitudinal direction to engage said leaf spring.

10. A hair clip as recited in claim 7 wherein said first and second members are formed of a rolled metallic material having an elongated grain structure and wherein the longitudinal axes of said grain structures in said first and second members are oriented substantially transversely to the longitudinal axes of said first and second members.

11. A hair clip as recited in claim 7 wherein said pivot means includes a pair of ears extending from said first member in the vicinity of said handle portion, each ear being pivotally secured in one of a pair of corresponding gaps formed in said second member.

* * * * *